US007435713B2

(12) United States Patent
Scheper et al.

(10) Patent No.: US 7,435,713 B2
(45) **Date of Patent: *Oct. 14, 2008**

(54) COMPOSITIONS AND METHODS FOR REMOVAL OF INCIDENTAL SOILS FROM FABRIC ARTICLES VIA SOIL MODIFICATION

(75) Inventors: William Michael Scheper, Lawrenceburg, IN (US); Michael Stanford Showell, Cincinnati, OH (US); Hiroshi Oh, Cincinnati, OH (US); David Lee Daugherty, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 447 days.

This patent is subject to a terminal disclaimer.

(21) Appl. No.: 11/051,831

(22) Filed: Feb. 4, 2005

(65) Prior Publication Data

US 2005/0137108 A1 Jun. 23, 2005

Related U.S. Application Data

(63) Continuation of application No. 10/308,525, filed on Dec. 3, 2002, now Pat. No. 6,890,892.

(60) Provisional application No. 60/338,193, filed on Dec. 6, 2001.

(51) Int. Cl.
*C11D 9/36* (2006.01)
*C11D 1/82* (2006.01)

(52) U.S. Cl. ..... 510/285; 510/276; 510/287; 510/289; 510/304; 510/338; 510/343; 510/356; 510/371; 510/400; 510/407; 510/413; 510/466

(58) Field of Classification Search ..... 510/276, 510/285, 287, 289, 304, 338, 343, 356, 371, 510/400, 407, 413, 466
See application file for complete search history.

(56) References Cited

U.S. PATENT DOCUMENTS

| | | | | |
|---|---|---|---|---|
| 4,097,397 | A | 6/1978 | Mizutani et al. | |
| 4,102,824 | A | 7/1978 | Mizutani et al. | |
| 4,639,321 | A | 1/1987 | Barrat et al. | |
| 4,685,930 | A | 8/1987 | Kasprzak | |
| 4,708,807 | A * | 11/1987 | Kemerer | 510/287 |
| 4,911,853 | A | 3/1990 | Coffindaffer et al. | |
| 5,057,240 | A | 10/1991 | Madore et al. | |
| 5,332,444 | A | 7/1994 | George et al. | |
| 5,676,705 | A * | 10/1997 | Jureller et al. | 8/142 |
| 5,676,938 | A * | 10/1997 | Kimura et al. | 424/78.03 |
| 5,705,562 | A | 1/1998 | Hill et al. | |
| 5,707,613 | A | 1/1998 | Hill et al. | |
| 5,865,852 | A | 2/1999 | Berndt et al. | |
| 5,876,510 | A | 3/1999 | Kuemin et al. | |
| 5,888,250 | A | 3/1999 | Hayday et al. | |
| 5,942,007 | A | 8/1999 | Berndt et al. | |
| 5,977,040 | A | 11/1999 | Inada et al. | |
| 5,985,810 | A | 11/1999 | Inada et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,136,766 | A | 10/2000 | Inada et al. | |
| 6,156,074 | A | 12/2000 | Hayday et al. | |
| 6,177,399 | B1 | 1/2001 | Mei et al. | |
| 6,258,130 | B1 | 7/2001 | Murphy et al. | |
| 6,273,919 | B1 | 8/2001 | Hayday et al. | |
| 6,309,425 | B1 | 10/2001 | Murphy et al. | |
| 6,310,029 | B1 | 10/2001 | Kilgour et al. | |
| 6,313,079 | B1 | 11/2001 | Murphy et al. | |
| 6,368,359 | B1 | 4/2002 | Perry et al. | |
| 6,548,465 | B2 * | 4/2003 | Perry et al. | 510/285 |
| 6,890,892 | B2 * | 5/2005 | Scheper et al. | 510/285 |
| 6,914,040 | B2 * | 7/2005 | Deak et al. | 510/285 |
| 2001/0020308 | A1 | 9/2001 | Murphy et al. | |
| 2001/0034912 | A1 | 11/2001 | Kilgour et al. | |
| 2002/0004953 | A1 | 1/2002 | Perry et al. | |
| 2002/0115582 | A1 | 8/2002 | Perry et al. | |
| 2002/0174493 | A1 | 11/2002 | Perry et al. | |

FOREIGN PATENT DOCUMENTS

| | | | |
|---|---|---|---|
| DE | 37 39 711 | A1 | 6/1989 |
| EP | 0246007 | A2 | 11/1987 |
| EP | 0 389 087 | | 1/1990 |
| EP | 0 375 028 | A2 | 6/1990 |
| EP | 0982 023 | A2 | 3/2000 |
| EP | 1 041 189 | A1 | 10/2000 |
| EP | 1 043 443 | A1 | 10/2000 |
| EP | 1092 803 | A1 | 4/2001 |
| JP | 53018646 | A2 | 2/1978 |
| JP | 04245970 | A | 9/1992 |
| JP | 5171566 | A2 | 7/1993 |
| JP | 2000-209-689 | | 10/2000 |
| WO | WO 92/10453 | A1 | 6/1992 |
| WO | WO 00/04221 | A1 | 1/2000 |

(Continued)

OTHER PUBLICATIONS

International Search Report.

*Primary Examiner*—Charles I Boyer
(74) *Attorney, Agent, or Firm*—Nicole M. Tepe; Kim William Zerby; Steven W. Miller

(57) ABSTRACT

Compositions and methods for removing and/or reducing incidental soils from fabric articles, especially articles of clothing, linen and drapery, wherein the compositions provide improved cleaning of incidental soils, either with or without a subsequent wash process or other entire fabric care process are provided. The compositions and methods are safe for use on a wide range of fabric articles, even in the home.

17 Claims, No Drawings

FOREIGN PATENT DOCUMENTS

| | | | |
|---|---|---|---|
| WO | WO 00/04222 | A1 | 1/2000 |
| WO | WO 00/63340 | A1 | 10/2000 |
| WO | WO 01/94678 | A1 | 12/2001 |
| WO | WO 01/94681 | A1 | 12/2001 |
| WO | WO 01/94684 | A1 | 12/2001 |
| WO | WO 02/97024 | A1 | 5/2002 |
| WO | WO 02/46517 | A1 | 6/2002 |
| WO | WO 02/48447 | A1 | 6/2002 |
| WO | WO 02/50366 | A1 | 6/2002 |
| WO | WO 02/077356 | A1 | 10/2002 |

* cited by examiner

COMPOSITIONS AND METHODS FOR REMOVAL OF INCIDENTAL SOILS FROM FABRIC ARTICLES VIA SOIL MODIFICATION

RELATED APPLICATIONS

This application is a continuation application of U.S. application Ser. No. 10/308,525, filed Dec. 3, 2002, now U.S. Pat. No. 6,890,892 which claims priority to U.S. Provisional Application Ser. No. 60/338,193 filed Dec. 6, 2001.

FIELD OF THE INVENTION

The present invention relates to compositions and methods for removing and/or reducing incidental soils from fabric articles, especially articles of clothing, linen and drapery, wherein the compositions provide improved cleaning of incidental soils, either with or without a subsequent wash process or other entire fabric care process. The compositions and methods are safe for use on a wide range of fabric articles, even in the home.

BACKGROUND OF THE INVENTION

The occurrence of incidental soils on fabric articles is a fact of life. If these soils cannot be removed from the fabric article, the article cannot be used again for its intended purpose because of its "dirty" appearance. The result is loss of use of an otherwise wearable garment, which is undesirable to the consumer because of the financial loss as well as the emotional attachment that some wearers have with clothing articles.

In the home, conventional laundry cleaning is carried out with relatively large amounts of water, typically in a washing machine at the consumer's home, or in a dedicated place such as a coin laundry. Although washing machines and laundry detergents have become quite sophisticated, the conventional laundry process still fails to remove some soils from fabric articles. A wide variety of "pre-treatment" compositions and devices are available to the consumer to assist in soil removal. These compositions often comprise enzymes, bleaching agents and surfactants and require a subsequent aqueous wash to complete soil removal. While effective in cleaning the soil, exposure of the fabric articles to high levels of water in the subsequent wash creates a risk of dye transfer and shrinkage. Moreover, a significant portion of fabric articles used by consumers is not suitable for cleaning in a conventional laundry process. Even fabric articles that are considered "washing machine safe" frequently come out of the laundry process badly wrinkled and require ironing, and may exhibit color loss.

More recently, home dry-cleaning kits have become available to the consumer. Some of these kits provide a means of treating incidental soils. However, these compositions comprise water and as such must be tested on fabric articles in an inconspicuous area prior to use, so as to ensure no fabric damage occurs (color bleeding, discoloration, residue formation, localized shrinkage, rings and the like).

Additionally, the consumer may desire to remove the incidental soil while still wearing the article, or just prior to re-wearing the article without subsequent treatment. Existing domestic pre-treatment systems can leave undesirable residues on clothing articles, even after an extended period of drying, and may visibly spread the soil over a larger area, creating rings around the original soil. These visible residues may leave the fabric article unusable without subsequent treatment, i.e. washing.

Accordingly there is an unmet need for compositions and methods for spot removal of soils from fabric articles which are safe for use in the home, safe for use on a wide range of fabric types including those sensitive to water, and which do not require subsequent conventional washing.

In contrast, commercial dry cleaning processes rely on non-aqueous solvents for cleaning. By avoiding water, these processes minimize the risk of shrinkage and wrinkling, however, cleaning of soils, particularly water-based and alcohol-based soils, is very limited with these processes. Typically, the dry-cleaner removes such soils manually prior to the dry-cleaning process. These methods are complex, requiring a wide range of compositions to address the variety of soils encountered, very labor intensive and often result in some localized damage to the treated article despite careful handling by the operator. Further complicating the process is the need to rinse or "level" the spot-treat fluid from the fabric article with solvent to avoid contaminating the non-aqueous fluid in the dry-cleaning machine with the spot-treatment chemicals.

Accordingly, there is also an unmet need in the dry-cleaning industry for cleaning compositions and methods that are simple to use, safe for use on dry-cleanable fabric articles, effective on a wide range of soils and which to not require additional treatment steps prior to the dry-cleaning operation.

SUMMARY OF THE INVENTION

The present invention provides safe-to-use compositions which exhibit improved cleaning (i.e., removing and/or reducing) of incidental soils from fabric articles compared to conventional soil removal compositions, while maintaining excellent fabric care properties. Also provided are methods for utilizing these compositions that require no additional treatment steps before an optional subsequent cleaning or refreshing step.

In general, compositions and methods of the present invention fall into two categories: (i) treating compositions and/or methods that modify, typically by chemically reacting with, one or more soil components to render the soil more soluble in a lipophilic fluid, especially in a silicone comprising solvent, as compared to the unmodified form of the soil components; and (ii) treating compositions and/or methods that modify, typically by chemically reacting with, one or more soil components to render the soil more soluble in a lipophilic fluid, for example more hydrophobic, as compared to the unmodified form of the soil components. The treating compositions of the present invention are typically formulated with additional cleaning ingredients, including solvents, surfactants, polymers, wetting agents, and/or hydrotropes.

In one aspect of the present invention, a method for removing and/or reducing an incidental soil from a fabric article in need of treatment comprising: a) contacting the soil present on the fabric article with a treating composition comprising: i) a non-aqueous fluid; ii) a protein derivitazation reagent capable of modifying the soil to enhance removal benefits upon contact with a lipophilic fluid; and b) optionally, removing a portion of the composition from the fabric article; and c) optionally, placing the treated fabric article into a subsequent cleaning process, preferably a cleaning process that utilizes a lipophilic fluid, such that the fabric article is treated, is provided.

In another aspect of the invention, a method for removing and/or reducing an incidental soil from a fabric article in need of treatment comprising: a) contacting the soil present on the fabric article with a treating composition comprising: i) a non-aqueous fluid; ii) a protein derivitazation reagent capable of modifying the soil to enhance removal benefits upon contact with a lipophilic fluid; and b) optionally, removing a portion of the composition from the fabric article; and c) optionally, placing the treated fabric article into a subsequent cleaning process, preferably a cleaning process that utilizes a lipophilic fluid, such that the fabric article is treated, is provided.

In yet another aspect of the invention, a method for removing and/or reducing an incidental soil from a fabric article in need of treatment comprising: a) contacting the soil present on the fabric article with a composition comprising: i) a non-aqueous fluid; ii) a protein derivitazation reagent capable of modifying the soil to enhance removal benefits upon contact with a lipophilic fluid; and placing the treated fabric article into a subsequent cleaning process, preferably a cleaning process that utilizes a silicone-containing lipophilic fluid, more preferably a cleaning process that utilizes a D5-containing cleaning fluid, such that the fabric article is treated, is provided.

In still yet another aspect of the present invention, an overall laundering process for an incidental soil-containing fabric article in need of treatment, wherein the process comprises the overall steps of:

(i) conducting a soil removal and/or reducing method according to the present invention on the incidental soil present on the fabric article; and (ii) laundering the entire treated fabric article from step (i) in a drycleaning laundering process, such that the fabric article is treated, is provided.

In even yet another aspect of the present invention, an overall soil removal process for removing and/or reducing an incidental soil present on a fabric article in need of treatment, wherein the process comprises the overall steps of:

(i) conducting a soil removal and/or reducing method according to the present invention on the incidental soil present on the fabric article; and (ii) drying the fabric article, such as by air drying and/or by placing the fabric article in a device, preferably a hot air clothes dryer, to provide agitation and agitating the fabric article to dry the fabric, such that the fabric article is treated, is provided.

In even still yet another aspect of the present invention, a kit comprising (i) a soil removal and/or reducing composition;

(ii) instructions for using the soil removal and/or reducing composition to remove and/or reduce an incidental soil present on an article, preferably a fabric article; and (iii) optionally, a practice soil which comprises a practice article comprising a soil upon which a user can practice the instructions for using the soil removal and/or reducing composition; and (iv) optionally, an absorbent soil receiver article.

Accordingly, the present invention provides methods for removing and/or reducing incidental soils present on articles, preferably fabric articles, that avoids negative wicking effects, and compositions and/or products and/or kits typically comprising instructions for utilizing the methods and/or compositions and/or products and/or kits to remove and/or reduce incidental soils present on an article.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (o C) unless otherwise specified. All measurements are in SI units unless otherwise specified. All documents cited are in relevant part, incorporated herein by reference.

DETAILED DESCRIPTION OF THE INVENTION

Definitions

The term "fabric article" and/or "fabric" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any nonaqueous fluid capable of removing sebum, as described in more detail herein below.

The term "volatile silicone" describes the well-know class of materials exemplified by the oligomers of dimethyl siloxane. The oligomers may be linear, branched or cyclic in nature. Preferred volatile silicones of the present invention are those that do not leave a visible residue at the end of the cleaning process. In general, preferred siloxane oligomers are those with a boiling point under normal conditions of 240° C. or lower.

The term "incidental soil" and/or "soil" refers to undesirable materials that are found on the fabric article. Generally, such incidental soils are found only on a portion of the article and are generated by accidental contact between the soil and the fabric article. Non-limiting examples of incidental soils are beverages, food sauces and condiments, bodily fluids such as blood, urine and feces, outdoor soils such as grass, mud and dirt, cosmetics such as make-up and lipstick. Such incidental soils are also commonly referred to as "stains". The term "incidental soils" as used herein does not include soils, such as sebum (skin secretions), oil and/or grease that are spread out over large portions of the fabric article. The incidental soils typically comprise functional groups selected from the group consisting of: alcohols, amides, amines, amino acids, carbohydrates, sugars and mixtures thereof. Such functional groups are not typically readily soluble in lipophilic fluids, thus, the need to make them more soluble by modifying such groups as described herein.

The concept of "modifying a soil and/or a soil component" as used herein means any action taken upon the soil, typically by a chemical reaction, that results in the soil being more soluble in a lipophilic fluid as compared to the soil in its unmodified state. Nonlimiting examples of actions that can be taken upon the soil include, elimination of polar groups, such as —OH, —NH and/or —SH groups, which the incidental soils typically contain. Known methods for modifying soils include, but are not limited to, silylation, alkylation and acylation. Agents capable of modifying the soils are herein described as incidental soil modifying agents (alternatively "derivatization reagents").

"Silylation" produces silyl derivatives of soils which are more soluble in lipophilic fluids, especially silicone-containing lipophilic fluids, than the unsilylated form of the soils. A common silylation method results in the replacement of active hydrogens present on the soils with a silyl group, such as a trimethylsilyl group. A nonlimiting example of a silyl reaction is as follows:

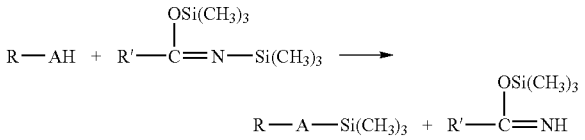

Nonlimiting examples of silylating reagents useful in silylation methods include hexamethyldisilzane, trimethylchlorosilane, trimethylsilylimidazole, bistrimethylsilylacetamide, bistrimethylsilyltrifluoroacetamide, N-methyltrimethylsilylfluoroacetamide, trimethylsilyldiethylamine, N-methyl-N-t-butyldimethylsilyltrifluoroacetamide, and halo-methylsilyl-containing materials.

"Alkylation" reduces molecular polarity by replacing active hydrogens with an alkyl group. Alkylating reagents are typically used to modify compounds with acidic hydrogens, such as carboxylic acids and phenols. These reagents produce esters, ethers, alkyl amines and alkyl amides.

Nonlimiting examples of alkylating reagents for use in alkylation include dialkylacetals, tetrabutylammonium hydroxide, $BF_3$, and pentafluorobenzyl bromide.

"Acylation" reduces the polarity of amino, hydroxyl, and thiol groups and adds halogenated functionalities to the soils. In comparison to silylating reagents, the acylating reagents target highly polar, multi-functional compounds, such as carbohydrates and amino acids. Acylation converts such compounds with active hydrogens into esters, thioesters, and amides.

Nonlimiting examples of acylating reagents useful in acylation methods include acyl anhydrides, such as fluorinated anhydrides (i.e., trifluoroacetoic anhydride, pentafluoropropionic anhydride, heptafluorobutyric anhydride), acyl halides, such as pentafluorobenzoyl chloride, fluoroacylimidazoles, such as trifluoroacetylimidazole, pentafluoropropanylimidazole, heptafluorobutyrylimidazole, pentafluoropropanol, and activated acyl amides, such as N-methyl-bis (trifluoroacetamide).

The term "treating composition" as used herein is intended to mean a composition comprising an incidental soil modifying agent (i.e, derivatization reagents).

The term "cleaning composition" used herein is intended to mean any lipophilic fluid-containing composition that comes into direct contact with fabric articles to be cleaned. It should be understood that the term encompasses uses other than cleaning, such as conditioning and sizing.

The term "capable of suspending water in a lipophilic fluid" means that a material is able to suspend, solvate or emulsify water, which is immiscible with the lipophilic fluid, at a level of 5% by weight of the composition in a way that the water remains visibly suspended, solvated or emulsified when left undisturbed for a period of at least five minutes after initial mixing of the components. In some examples of compositions in accordance with the present invention, the compositions may be colloidal in nature and/or appear milky. In other examples of compositions in accordance with the present invention, the compositions may be transparent.

The term "insoluble in a lipophilic fluid" means that when added to a lipophilic fluid, a material physically separates from the lipophilic fluid (i.e. settle-out, flocculate, float) within 5 minutes after addition, whereas a material that is "soluble in a lipophilic fluid" does not physically separate from the lipophilic fluid within 5 minutes after addition.

The term "mixing" as used herein means combining two or more materials (i.e., fluids, more specifically a lipophilic fluid and a consumable detergent composition) in such a way that a homogeneous mixture is formed. Suitable mixing processes are known in the art. Non-limiting examples of suitable mixing processes include vortex mixing processes and static mixing processes.

Compositions

The present invention provides compositions which exhibit improved cleaning (i.e., removal and/or reduction) of incidental soils from fabric articles while maintaining excellent fabric care properties.

Blood proteins are hydrophilic polymers which contain large amount of hydrophilic functional groups such as amide, amine, hydroxyl, mercapto, carboxylic groups. These are among the toughtest soil to clean in a lipophilic fluid cleaning system.

Soil modifying agents (i.e., derivatization reagents) commonly used in analytical chemistry for chromatography separation and fluororencent labeling are applied to blood protein modification-hydrophobization. Hydrophobization of the blood stain improved the cleaning performance in D5 macroemulsion system. The preferred hydrophobization reagents in the present invention are: (1) silylation: a solution with ratio of 3:1:9:1 of hexamethyldisilazane:trimethylchlorosilane:pyridine:N,O-bis-(trimethylsilyl) acetamide; (2) isoindolation: 2-(a) a solution with ratio of 1000:1 of o-phthaldialdehyde: 2-mercaptoethanol; 2-(b) hydrophobically modified analogs of o-phthaldialdehyde, such as $HCOC_6H_4CN(Si(CH_3)_2O)_n$—X or $HCOC_6H_4CH_2NH(Si(CH_3)_2O)_n$—X, wherein n is 2-50, X is H, $CH_3$, OH, $NH_2$, or alkyl or PDMS derivatized o-phthaldialdehyde; (3) isothiocyanation (to form phenyl or alkyl thiohydantoins): phenyl isothiocyanate or C1-C8 alkyl isothiocyanate; (4) alkylene oxide, e.g. 1,2-epoxybutane; (5) PDMS branched with alkylene oxide, e.g., X—$(Si(CH_3)_2O)_m$—$(SiO(CH_3)((CH_2)_a$—$OCH_2$—$CHOCH_2)))$—$(Si(CH_3)_2O)_n$—X, wherein m is 1-10, n is 1-10, a is 1-5, X is H, $CH_3$, OH, $NH_2$; or $CH_2OCHCH_2O(CH_2)_3Si(CH_3)_2O(Si(CH_3)_2O)_nSi(CH_3)_2(CH_2)_3OCH_2CHOCH_2$ of Gelest, Inc.; or $CH_3Si(CH_3)_2O(Si(CH_3)_2O)_m(Si(CH_3)(CH_2CH_2C_6H_9O)O)_nSi(CH_3)_2CH_3$ of Gelest, wherein n is 1-50, m is 1-50; (6) epichlorohydrin; (7) CNBr; (8) alkyl aldehyde and $NaCNBH_3$.

An emulsion or co-solvent system consists of D5, $H_2O$ and surfactant or solvent removes these hydrophobically modified blood proteins. The system consists of 85% -100% of D5, 5% -15% of $H_2O$, 0.5%-3% of surfactant or 80%-100% of D5, 0.5% -15% of $H_2O$, 0.5%-20% of solvent. Surfactants can be AES, LAS, Ca— or $NH_4$— LAS, PDMS or twin alkyl branched with peptide or alkyl ethoxylate or amino alkyl or alkyl ethoxylated sulfate or sugar. Solvents can be polar solvents like TFA, MEA, DEA, alcohols (n=1-4), alkylene diols (n=1-5), acetonitrile, DMF, CHCl3, trichloroethan, urea, DMSO, etc.

Lipophilic Fluid

The lipophilic fluid herein is one having a liquid phase present under operating conditions of a fabric article treating appliance, in other words, during treatment of a fabric article in accordance with the present invention. In general such a lipophilic fluid can be fully liquid at ambient temperature and pressure, can be an easily melted solid, e.g., one which becomes liquid at temperatures in the range from about 0 deg. C. to about 60 deg. C., or can comprise a mixture of liquid and vapor phases at ambient temperatures and pressures, e.g., at 25 deg. C. and 1 atm. pressure. Thus, the lipophilic fluid is not a compressible gas such as carbon dioxide.

It is preferred that the lipophilic fluids herein be nonflammable or have relatively high flash points and/or low VOC (volatile organic compound) characteristics, these terms having their conventional meanings as used in the dry cleaning industry, to equal or, preferably, exceed the characteristics of known conventional dry cleaning fluids.

Moreover, suitable lipophilic fluids herein are readily flowable and nonviscous.

In general, lipophilic fluids herein are required to be fluids capable of at least partially dissolving sebum or body soil as defined in the test hereinafter. Mixtures of lipophilic fluid are also suitable, and provided that the requirements of the Lipophilic Fluid Test, as described below, are met, the lipophilic fluid can include any fraction of dry-cleaning solvents, especially newer types including fluorinated solvents, or perfluorinated amines. Some perfluorinated amines such as perfluorotributylamines while unsuitable for use as lipophilic fluid may be present as one of many possible adjuncts present in the lipophilic fluid-containing composition.

Other suitable lipophilic fluids include, but are not limited to, diol solvent systems e.g., higher diols such as C6- or C8- or higher diols, organosilicone solvents including both cyclic and acyclic types, and the like, and mixtures thereof.

A preferred group of nonaqueous lipophilic fluids suitable for incorporation as a major component of the compositions of the present invention include low-volatility nonfluorinated organics, silicones, especially those other than amino functional silicones, and mixtures thereof. Low volatility nonfluorinated organics include for example OLEAN® and other polyol esters, or certain relatively nonvolatile biodegradable mid-chain branched petroleum fractions.

Another preferred group of nonaqueous lipophilic fluids suitable for incorporation as a major component of the compositions of the present invention include, but are not limited to, glycol ethers, for example propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether. Suitable silicones for use as a major component, e.g., more than 50%, of the composition include cyclopentasiloxanes, sometimes termed "D5", and/or linear analogs having approximately similar volatility, optionally complemented by other compatible silicones. Suitable silicones are well known in the literature, see, for example, Kirk Othmer's Encyclopedia of Chemical Technology, and are available from a number of commercial sources, including General Electric, Toshiba Silicone, Bayer, and Dow Corning. Other suitable lipophilic fluids are commercially available from Procter & Gamble or from Dow Chemical and other suppliers.

Qualification of Lipophilic Fluid and Lipophilic Fluid Test (LF Test)

Any nonaqueous fluid that is both capable of meeting known requirements for a dry-cleaning fluid (e.g, flash point etc.) and is capable of at least partially dissolving sebum, as indicated by the test method described below, is suitable as a lipophilic fluid herein. As a general guideline, perfluorobutylamine (Fluorinert FC-43®) on its own (with or without adjuncts) is a reference material which by definition is unsuitable as a lipophilic fluid for use herein (it is essentially a nonsolvent) while cyclopentasiloxanes have suitable sebum-dissolving properties and dissolves sebum.

The following is the method for investigating and qualifying other materials, e.g., other low-viscosity, free-flowing silicones, for use as the lipophilic fluid. The method uses commercially available Crisco® canola oil, oleic acid (95% pure, available from Sigma Aldrich Co.) and squalene (99% pure, available from J. T. Baker) as model soils for sebum. The test materials should be substantially anhydrous and free from any added adjuncts, or other materials during evaluation.

Prepare three vials, each vial will contain one type of lipophilic soil. Place 1.0 g of canola oil in the first; in a second vial place 1.0 g of the oleic acid (95%), and in a third and final vial place 1.0 g of the squalene (99.9%). To each vial add 1 g of the fluid to be tested for lipophilicity. Separately mix at room temperature and pressure each vial containing the lipophilic soil and the fluid to be tested for 20 seconds on a standard vortex mixer at maximum setting. Place vials on the bench and allow to settle for 15 minutes at room temperature and pressure. If, upon standing, a clear single phase is formed in any of the vials containing lipophilic soils, then the nonaqueous fluid qualifies as suitable for use as a "lipophilic fluid" in accordance with the present invention. However, if two or more separate layers are formed in all three vials, then the amount of nonaqueous fluid dissolved in the oil phase will need to be further determined before rejecting or accepting the nonaqueous fluid as qualified.

In such a case, with a syringe, carefully extract a 200-microliter sample from each layer in each vial. The syringe-extracted layer samples are placed in GC auto sampler vials and subjected to conventional GC analysis after determining the retention time of calibration samples of each of the three models soils and the fluid being tested. If more than 1% of the test fluid by GC, preferably greater, is found to be present in any one of the layers which consists of the oleic acid, canola oil or squalene layer, then the test fluid is also qualified for use as a lipophilic fluid. If needed, the method can be further calibrated using heptacosafluorotributylamine, i.e., Fluorinert FC-43 (fail) and cyclopentasiloxane (pass). A suitable GC is a Hewlett Packard Gas Chromatograph HP5890 Series II equipped with a split/splitless injector and FID. A suitable column used in determining the amount of lipophilic fluid present is a J&W Scientific capillary column DB-1HT, 30 meter, 0.25 mm id, 0.1 um film thickness cat# 1221131. The GC is suitably operated under the following conditions:

Carrier Gas: Hydrogen
Column Head Pressure: 9 psi
Flows: Column Flow @~1.5 ml/min.
  Split Vent @~-250-500 ml/min.
  Septum Purge @1 ml/min.
Injection: HP 7673 Autosampler, 10 ul syringe, 1 ul injection
Injector Temperature: 350° C.
Detector Temperature: 380° C.
Oven Temperature Program: initial 60° C. hold 1 min.
  rate 25° C./min.
  final 380° C. hold 30 min.

Preferred lipophilic fluids suitable for use herein can further be qualified for use on the basis of having an excellent garment care profile. Garment care profile testing is well known in the art and involves testing a fluid to be qualified using a wide range of garment or fabric article components, including fabrics, threads and elastics used in seams, etc., and a range of buttons. Preferred lipophilic fluids for use herein have an excellent garment care profile, for example they have a good shrinkage and/or fabric puckering profile and do not appreciably damage plastic buttons. Certain materials which in sebum removal qualify for use as lipophilic fluids, for example ethyl lactate, can be quite objectionable in their tendency to dissolve buttons, and if such a material is to be used in the compositions of the present invention, it will be formulated with water and/or other solvents such that the overall mix is not substantially damaging to buttons. Other lipophilic fluids, D5, for example, meet the garment care requirements quite admirably. Some suitable lipophilic fluids may be found in granted U.S. Pat. Nos. 5,865,852; 5,942,007; 6,042,617; 6,042,618; 6,056,789; 6,059,845; and 6,063,135, which are incorporated herein by reference.

Lipophilic fluids can include linear and cyclic polysiloxanes, hydrocarbons and chlorinated hydrocarbons, with the exception of PERC and DF2000 which are explicitly not covered by the lipophilic fluid definition as used herein. More preferred are the linear and cyclic polysiloxanes and hydrocarbons of the glycol ether, acetate ester, lactate ester families. Preferred lipophilic fluids include cyclic siloxanes having a boiling point at 760 mm Hg. of below about 250° C. Specifically preferred cyclic siloxanes for use in this invention are octamethylcyclotetrasiloxane, decamethylcyclopentasiloxane, and dodecamethylcyclohexasiloxane. Preferably, the cyclic siloxane comprises decamethylcyclopentasiloxane (D5, pentamer) and is substantially free of octamethylcyclotetrasiloxane (tetramer) and dodecamethylcyclohexasiloxane (hexamer).

However, it should be understood that useful cyclic siloxane mixtures might contain, in addition to the preferred cyclic siloxanes, minor amounts of other cyclic siloxanes including octamethylcyclotetrasiloxane and hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture. The industry standard for cyclic siloxane mixtures is that such mixtures comprise less than about 1% by weight of the mixture of octamethylcyclotetrasiloxane.

Accordingly, the lipophilic fluid of the present invention preferably comprises more than about 50%, more preferably more than about 75%, even more preferably at least about 90%, most preferably at least about 95% by weight of the lipophilic fluid of decamethylcyclopentasiloxane. Alternatively, the lipophilic fluid may comprise siloxanes which are a mixture of cyclic siloxanes having more than about 50%, preferably more than about 75%, more preferably at least about 90%, most preferably at least about 95% up to about 100% by weight of the mixture of decamethylcyclopentasiloxane and less than about 10%, preferably less than about 5%, more preferably less than about 2%, even more preferably less than about 1%, most preferably less than about 0.5% to about 0% by weight of the mixture of octamethylcyclotetrasiloxane and/or dodecamethylcyclohexasiloxane.

The level of lipophilic fluid present in the cleaning compositions according to the present invention may be from about 70% to about 99.99% and/or from about 90% to about 99.9% and/or from about 95% to about 99.8% by weight of the cleaning composition. The level of lipophilic fluid, when present in a consumable detergent composition useful for the present invention, may be from about 0% to about 90% and/or from about 0.1% to about 75% and/or from about 1% to about 50% by weight of the consumable detergent composition.

Surfactant Component

The treating compositions of the present invention typically comprise a surfactant in addition to the soil modifying agent. The surfactant component of the present invention is a material that is capable of suspending water in a lipophilic fluid and enhancing soil removal benefits of a lipophilic fluid. As a condition of their performance, the materials are soluble in the lipophilic fluid.

The surfactant component of the present invention can be a material that is capable of suspending water in a lipophilic fluid and/or enhancing soil removal benefits of a lipophilic fluid. The materials may be soluble in the lipophilic fluid.

One class of materials can include siloxane-based surfactants (siloxane-based materials). The siloxane-based surfactants in this application may be siloxane polymers for other applications. The siloxane-based surfactants typically have a weight average molecular weight from 500 to 20,000. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Suitable siloxane-based surfactants comprise a polyether siloxane having the formula:

$$M_a D_b D'_c D''_d M'_{2-a}$$

wherein a is 0-2; b is 0-1000; c is 0-50; d is 0-50, provided that a+c+d is at least 1;

M is $R^1_{3-e}X_eSiO_{1/2}$ wherein $R^1$ is independently H, or a monovalent hydrocarbon group, X is hydroxyl group, and e is 0 or 1;

M' is $R^2_3SiO_{1/2}$ wherein $R^2$ is independently H, a monovalent hydrocarbon group, or $(CH_2)_f—(C6H4)_gO—(C_2H_4O)_h—(C_3H_6O)_i—(C_kH_{2k}O)_j—R^3$, provided that at least one $R^2$ is $(CH_2)_f—(C6H4)_g O—(C_2H_4O)_h—(C_3H_6O)_i—(C_kH_{2k}O)_j—R^3$, wherein $R^3$ is independently H, a monovalent hydrocarbon group or an alkoxy group, f is 1-10, g is 0 or 1, h is 1-50, i is 0-50, j is 0-50, k is 4-8;

D is $R^4_2SiO_{2/2}$ wherein $R^4$ is independently H or a monovalent hydrocarbon group;

D' is $R^5_2SiO_{2/2}$ wherein $R^5$ is independently $R^2$ provided that at least one $R^5$ is $(CH_2)_f—(C6H4)_g O—(C_2H_4O)_h—(C_3H_6O)_i—(C_kH_{2k}O)_j—R^3$, wherein $R^3$ is independently H, a monovalent hydrocarbon group or an alkoxy group, f is 1-10, g is 0 or 1, h is 1-50, i is 0-50, j is 0-50, k is 4-8; and D" is $R^6_2SiO_{2/2}$ wherein $R^6$ is independently H, a monovalent hydrocarbon group or $(CH_2)_l(C_6H_4)_m(A)_n$-$[(L)_o$-$(A')_p$-$]_q$-$(L')_rZ(G)_s$, wherein l is 1-10; m is 0 or 1; n is 0-5; o is 0-3; p is 0 or 1; q is 0-10; r is 0-3; s is 0-3; $C_6H_4$ is unsubstituted or substituted with a $C_{1-10}$ alkyl or alkenyl; A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' are each independently a $C_{1-30}$ straight chained or branched alkyl or alkenyl or an aryl which is unsubstituted or substituted; Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$alkyl or alkenyl, a carbohydrate unsubstituted or substituted with a $C_{1-10}$alkyl or alkenyl or an ammonium; G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. No. 5,676,705, U.S. Pat. No. 5,683,977, U.S. Pat. No. 5,683,473, and EP-1,092,803A1 (all to Lever Brothers).

Nonlimiting commercially available examples of suitable siloxane-based surfactants are TSF 4446® (ex. General Electric Silicones) and Y12147® (ex. OSi Specialties).

A second preferred class of materials suitable for the surfactant component is organic in nature. Preferred materials are organosulfosuccinate surfactants, with carbon chains of from about 6 to about 20 carbon atoms. Most preferred are organosulfosuccinates containing dialkyl chains, each with carbon chains of from about 6 to about 20 carbon atoms. Also preferred are chains containing aryl or alkyl aryl, substituted or unsubstituted, branched or linear, saturated or unsaturated groups.

Nonlimiting commercially available examples of suitable organosulfosuccinate surfactants are available under the trade names of Aerosol OT® and Aerosol TR-70® (ex. Cytec).

The surfactant component, when present in the fabric article treating compositions of the present invention, preferably comprises from about 0.01% to about 10%, more preferably from about 0.02% to about 5%, even more preferably from about 0.05% to about 2% by weight of the fabric article treating composition.

The surfactant component, when present in the consumable detergent compositions of the present invention, preferably comprises from about 1% to about 99%, more preferably 2% to about 75%, even more preferably from about 5% to about 60% by weight of the consumable detergent composition.

Another preferred class of surfactants is nonionic surfactants, especially those having low HLB values. Preferred nonionic surfactants have HLB values of less than about 10, more preferably less than about 7.5, and most preferably less than about 5. Preferred nonionic surfactants also have from about 6-20 carbons in the surfactant chain and from about 1-15 ethylene oxide (EO) and/or propylene oxide (PO) units in the hydrophilic portion of the surfactant (i.e., C6-20 EO/PO 1-15), and preferably nonionic surfactants selected from those within C7-11 EO/PO 1-5 (e.g., C7-11 EO 2.5).

The surfactant laundry additives, when present, typically comprises from about 0.001% to about 10%, more preferably from about 0.01% to about 5%, even more preferably from about 0.02% to about 2% by weight of the cleaning composition combined with the lipophilic fluid for the present invention process. These surfactant laundry additives, when present in the consumable detergent compositions before addition to the lipophilic fluid, preferably comprises from about 1% to about 90%, more preferably 2% to about 75%, even more preferably from about 5% to about 60% by weight of the consumable detergent composition.

Amino-functional Silicone

Suitable amino-functional silicones for use in the compositions of the present invention have the formula described above for the surfactant component, with the exception that the D" is $R^5{}_2SiO_{2/2}$ wherein $R^5$ is $(CH_2)_f$—(C6H4)$_z$ O—$R^6$ where $R^6$ is an amino-containing alkyl group.

Nonlimiting commercially available examples of suitable amino-functional silicones are available under the trade names of XS69-B5476® (ex. General Electric Silicones) and Jenamine HSX® (ex. DelCon).

Polar Solvent

Compositions according to the present invention may further comprise a polar solvent. Non-limiting examples of polar solvents include: water, alcohols, glycols, polyglycols, ethers, carbonates, dibasic esters, ketones, other oxygenated solvents, and mixtures thereof. Further examples of alcohols include: C1-C126 alcohols, such as propanol, ethanol, isopropyl alcohol, etc., benzyl alcohol, and diols such as 1,2-hexanediol. The Dowanol® series by Dow Chemical are examples of glycols and polyglycols useful in the present invention, such as Dowanol® TPM, TPnP, DPnB, DPnP, TPnB, PPh, DPM, DPMA, DB, and others. Further examples include propylene glycol, butylene glycol, polybutylene glycol and more hydrophobic glycols. Examples of carbonate solvents are ethylene, propylene and butylene carbonantes such as those available under the Jeffsol® tradename. Polar solvents for the present invention can be further identified through their dispersive ($\delta_D$), polar ($\delta_P$) and hydrogen bonding ($\delta_H$) Hansen solubility parameters. Preferred polar solvents or polar solvent mixtures have fractional polar ($f_P$) and fractional hydrogen bonding ($f_H$) values of $f_P>0.02$ and $f_H>0.10$, where $f_P=\delta_P/(\delta_D+\delta_P+\delta_H)$ and $f_H=\delta_H/(\delta_D+\delta_P+\delta_H)$ more preferably $f_P>0.05$ and $f_H>0.20$, and most preferably $f_P>0.07$ and $f_H>0.30$.

In the detergent composition of the present invention, the levels of polar solvent can be from about 0 to about 70%, preferably 1 to 50%, even more preferably 1 to 30% by weight of the detergent composition.

Water, when present in the wash fluid fabric article treating compositions of the present invention, the wash fluid composition may comprise from about 0.001% to about 10%, more preferably from about 0.005% to about 5%, even more preferably from about 0.01% to about 1% by weight of the wash fluid fabric article treating composition.

Water, when present in the detergent compositions of the present invention, preferably comprises from about 1% to about 90%, more preferably from about 2% to about 75%, even more preferably from about 5% to about 40% by weight of the consumable detergent composition.

Cleaning Adjuncts

The compositions of the present invention optionally further comprise at least one additional cleaning adjunct. The cleaning adjuncts can vary widely and can be used at widely ranging levels. For example, detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. Cleaning adjuncts that are catalytic, for example enzymes, can be used in "forward" or "reverse" modes, a discovery independently useful from the fabric treating methods of the present invention. For example, a lipolase or other hydrolase may be used, optionally in the presence of alcohols as cleaning adjuncts, to convert fatty acids to esters, thereby increasing their solubility in the lipophilic fluid. This is a "reverse" operation, in contrast with the normal use of this hydrolase in water to convert a less water-soluble fatty ester to a more water-soluble material. In any event, any cleaning adjunct must be suitable for use in combination with a lipophilic fluid in accordance with the present invention.

Some suitable cleaning adjuncts include, but are not limited to, builders, surfactants, other than those described above with respect to the surfactant component, enzymes, bleach activators, bleach catalysts, bleach boosters, bleaches, alkalinity sources, antibacterial agents, colorants, perfumes, properfumes, finishing aids, lime soap dispersants, odor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

Suitable odor control agents, which may optionally be used as finishing agents, include agents include, cyclodextrins, odor neutralizers, odor blockers and mixtures thereof. Suitable odor neutralizers include aldehydes, flavanoids, metallic salts, water-soluble polymers, zeolites, activated carbon and mixtures thereof.

Perfumes and perfumery ingredients useful in the compositions of the present invention comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes may comprise extremely complex mixtures of such ingredients. Pro-perfumes are also useful in the present invention. Such materials are those precursors or mixtures thereof capable of chemically reacting, e.g., by hydrolysis, to release a perfume, and are described in patents and/or published patent applications to Procter and Gamble, Firmenich, Givaudan and others.

Bleaches, especially oxygen bleaches, are another type of cleaning adjunct suitable for use in the compositions of the present invention. This is especially the case for the activated and catalyzed forms with such bleach activators as nonanoyloxybenzenesulfonate and/or any of its linear or branched higher or lower homologs, and/or tetraacetylethylenediamine and/or any of its derivatives or derivatives of phthaloylimidoperoxycaproic acid (PAP) or other imido- or amido-substituted bleach activators including the lactam types, or more generally any mixture of hydrophilic and/or hydrophobic bleach activators (especially acyl derivatives including those of the $C_6$-$C_{16}$ substituted oxybenzenesulfonates).

Also suitable are organic or inorganic peracids both including PAP and other than PAP. Suitable organic or inorganic peracids for use herein include, but are not limited to: percarboxylic acids and salts; percarbonic acids and salts; perimidic acids and salts; peroxymonosulfuric acids and salts; persulphates such as monopersulfate; peroxyacids such as diperoxydodecandioic acid (DPDA); magnesium peroxyphthalic acid; perlauric acid; perbenzoic and alkylperbenzoic acids; and mixtures thereof.

One class of suitable organic peroxycarboxylic acids has the general formula:

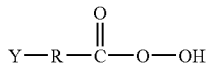

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Particularly preferred peracid compounds are those having the formula:

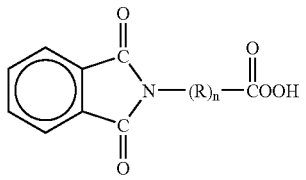

wherein R is $C_{1-4}$ alkyl and n is an integer of from 1 to 5. A particularly preferred peracid has the formula where R is $CH_2$ and n is 5 i.e., phthaloylamino peroxy caproic acid (PAP) as described in U.S. Pat. Nos. 5,487,818, 5,310,934, 5,246,620, 5,279,757 and 5,132,431. PAP is available from Ausimont SpA under the tradename Euroco.

Hydrogen peroxide is a highly preferred bleaching agent.

Other cleaning adjuncts suitable for use in the compositions of the present invention include, but are not limited to, builders including the insoluble types such as zeolites including zeolites A, P and the so-called maximum aluminum P as well as the soluble types such as the phosphates and polyphosphates, any of the hydrous, water-soluble or water-insoluble silicates, 2,2'-oxydisuccinates, tartrate succinates, glycolates, NTA and many other ethercarboxylates or citrates; chelants including EDTA, S,S'-EDDS, DTPA and phosphonates; water-soluble polymers, copolymers and terpolymers; soil release polymers; optical brighteners; processing aids such as crisping agents and/fillers; anti-redeposition agents; hydrotropes, such as sodium, or calcium cumene sulfonate, potassium napthalenesulfonate, or the like, humectant; other perfumes or pro-perfumes; dyes; photobleaches; thickeners; simple salts; alkalis such as those based on sodium or potassium including the hydroxides, carbonates, bicarbonates and sulfates and the like; and combinations of one or more of these cleaning adjuncts.

One particularly preferred class of cleaning adjuncts is additives comprising a strongly polar and/or hydrogen-bonding head group, further enhances soil removal by the compositions of the present invention. Examples of the strongly polar and/or hydrogen-bonding head group are alcohols, carboxylic acids, sulfates, sulphonates, phosphates, phosphonates, and nitrogen containing materials. Preferred additives are nitrogen containing materials selected from the group consisting of primary, secondary and tertiary amines, diamines, triamines, ethoxylated amines, amine oxides, amides, betaines, quaternary ammonium salts, and mixtures thereof. Most highly preferred materials are amino-functional siloxanes, having one or more of the following properties: i) at least about 60% by weight silicone content; and ii) alkyleneoxy groups, most preferably ethyleneoxy groups.

The cleaning adjunct(s) preferably comprise(s) from about 0.01% to about 10%, more preferably from about 0.02% to about 7%, even more preferably from about 0.05% to about 5% by weight of the composition.

Methods

In a typical method of soil removal of the present invention, the soil removal and/or reducing composition of the present invention is used in conjunction with an absorbent soil receiver and is releasably housed within a container, which is provided with a dispensing means. (The combination of container and its dispensing means is herein referred to conjointly as the "dispenser"). In the process of this invention, a fabric is inspected for any localized area of stain. The soiled area is then placed in close contact with an absorbent soil receiver and treated by means of the dispenser.

As discussed herein, the compositions of the present invention may be employed in a process for removing and/or reducing a soil from a localized stained area on a fabric article, comprising the steps of placing the soiled area of the fabric over and in contact with an absorbent soil receiver; applying a composition according to the present invention to the soil, preferably from a container having a dispenser spout.

The absorbent soil receiver that is used in the pre-spotting operation herein can be any absorbent material, which imbibes the composition of the present invention used in the pre-spotting operation. Disposable paper towels, cloth towels such as BOUNTY® brand towels, clean rags, etc., can be used. However, in a preferred mode the absorbent soil receiver is designed specifically to "wick" or "draw" the soil removal composition away from the soiled area. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the soil removal composition from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

Another type of soil receiver for use herein comprises Functional Absorbent Materials ("FAM's"), which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the soiled area of the garment or fabric swatch is placed over a section of the soil receiver, followed by treatment with the soil removal composition of the present invention, preferably in conjunction with the tip of the dispenser tube to provide mechanical agitation. Repeated manipulations with the tip and the detergency effect of the soil removal composition serve to loosen the soil and transfer it to the receiver. While spot cleaning progresses, the suction effects of the receiver capillaries cause the soil removal composition and soil debris to be carried into the receiver, where the soil debris is largely retained. At the end of this step the soil as well as almost all of the soil removal composition is found to have been removed from the fabric being treated and transferred to the receiver. This leaves the fabric surface only damp, with little or no residue of the soil removal composition/soil debris that can lead to undesirable rings on the fabrics.

A typical dispenser herein has the following dimensions, which are not to be considered limiting thereof. The volume of the container bottle used on the dispenser is typically 2 oz.-4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal end of the spout.

Another method for removing soils from fabric articles that can be used with the compositions of the present invention is to initially encircle the soiled area to be treated (or substantially encircle if the soiled area is on an edge of the fabric article) with the soil removal composition prior to contacting the soiled area with the soil removal composition.

Kits

The products of the present invention (soil removal and/or reducing composition plus, optionally, instructions for using) may be incorporated into kits in accordance with the present invention.

In a preferred embodiment, a kit in accordance with the present invention comprises a soil removal composition and instructions for removing and/or reducing soils from an article, and optionally an absorbent stain receiver.

TREATED ARTICLE

An article, especially a fabric article that has been treated in accordance a method of the present invention is also within the scope of the present invention. Preferably such a treated fabric article comprises an analytically detectable amount of at least one compound (e.g., an organosilicone) having a surface energy modifying effect but no antistatic effect; or an analytically detectable amount of at least one compound having a surface energy modifying and/or feel-modifying and/or comfort-modifying and/or aesthetic effect and at least one antistatic agent other than the above-mentioned compound.

What is claimed is:

1. A composition comprising:

a. a soil modifying agent selected from the group consisting of: hexamethyldisilazane;
trimethylchlorosilane; trimethylsilylimidazole; bistrimethylsilylacetamide;
bistrimethylsilyltrifluoroacetamide; N-methyl-trimethylsilylfluoroacetamide;
trimethylsilyldiethylamine; N-methyl-N-t-butyldimethylsilyltrifluoroacetamide; and
halomethylsilyl-containing materials; a solution of hexamethyldisilazane,
trimethylchlorosilane, pyridine and N,O-bis-(trimethylsilyl)acetamide;
and mixtures thereof; and b. from about 60% to about 99.95%, by weight of the composition, of a solvent mixture comprising a lipophilic fluid; and c. optionally, a surfactant component; and d. optionally, at least one additional non-solvent cleaning adjunct; wherein the composition is formulated for the removal and/or reduction of incidental soils from a fabric article.

2. The composition according to claim 1 wherein the surfactant component is present in the composition at from about 0.01% to about 10% by weight of the composition.

3. The composition according to claim 1 wherein the surfactant component comprises a surfactant selected from the group consisting of siloxane-based surfactants, organosulfosuccinate surfactants, AES, LAS, CaLAS or $NH_4$LAS, and mixtures thereof.

4. The composition according to claim 3 wherein the surfactant component is a siloxane-based surfactant selected from the group consisting of a polyether siloxane, a polyethoxylated sulfate siloxane, a peptide siloxane and mixtures thereof.

5. The composition according to claim 4 wherein the surfactant component comprises a siloxane-based surfactant having at least one of the following properties:

i) siloxane content of at least about 60% by weight;

ii) HLB of from about 0.1 to about 8;

iii) alkyleneoxy functional groups;

iv) alkylethoxylated sulfate functional groups; or v) peptide functional groups.

6. The composition according to claim 1 wherein the non-solvent cleaning adjunct is chosen from the group consisting of builders, surfactants, emulsifying agents, enzymes, bleach activators, bleach catalysts, bleach boosters, bleaches, alkalinity sources, antibacterial agent, colorants, perfume, lime soap dispersants, odor control agents, odor neutralizers, polymeric dye transfer inhibiting agents, crystal growth inhibitors, photobleaches, heavy metal ion sequestrants, antbtarnishing agents, anti-microbial agents, anti-oxidants, anti-redeposition agents, soil release polymers, electrolytes, pH modifiers, thickeners, abrasives, divalent ions, metal ion salts, enzyme stabilizers, corrosion inhibitors, diamines, suds stabilizing polymers, solvents, process aids, sizing agents, optical brighteners, hydrotropes, and mixtures thereof

7. The composition according to claim 1 wherein the non-solvent cleaning adjunct comprises an amino-functional silicone having one or more of the following properties:

i) at least about 60% by weight silicone content; and ii) alkyleneoxy groups.

8. The composition of claim 1 wherein the non-solvent cleaning adjunct comprises a bleaching agent, an enzyme, or mixtures thereof.

9. The composition of claim 1 wherein the lipophilic fluid is selected from the group consisting of: linear, branched and cyclic volatile silicones, and mixtures thereof.

10. The composition according to claim 9 wherein the lipophilic fluid comprises decamethylcyclopentasiloxane.

11. A method for removing and/or reducing incidental soils present on a fabric article in need of treatment comprising the step of contacting the soiled area of the fabric article with the composition according to claim 1, and optionally, placing the treated fabric article into a subsequent cleaning and/or refreshing cycle.

12. The method according to claim 11 wherein the subsequent cleaning and/or refreshing cycle comprises the step of contacting the fabric article with a lipophilic fluid.

13. The method according to claim 12 wherein water is present in the lipophilic fluid at from about 0% to about 10% by weight of the lipophilic fluid.

14. The composition according to claim 1 wherein the solvent mixture contains decamethylcyclopentasiloxane, water and a surfactant or apolar solvent.

15. The composition according to claim 14 wherein the solvent mixture comprises 85 to 100% decamethylcyclopentasiloxane, 5 to 15% water and 0.5 to 3% surfactant.

16. The composition according to claim 14 wherein the solvent mixture comprises 80 to 100% decamethylcyclopentasiloxane, 0.5 to 15% water and 0.5 to 20% polar solvent.

17. A method for removing and/or reducing incidental soils present on a fabric article in need of treatment comprising the step of contacting the soiled area of the fabric article with the composition according to claim 14, and optionally, placing the treated fabric article into a subsequent cleaning and/or refreshing cycle.

* * * * *

UNITED STATES PATENT AND TRADEMARK OFFICE

CERTIFICATE OF CORRECTION

PATENT NO. : 7,435,713 B2
APPLICATION NO. : 11/051831
DATED : October 14, 2008
INVENTOR(S) : William Michael Scheper et al.

It is certified that error appears in the above-identified patent and that said Letters Patent is hereby corrected as shown below:

Column 8
Line 45, delete "~-250" and insert -- ~250 --.

Col. 17, Line 16-17, delete "antbtar-nishing" and insert -- antitar-nishing --.

Signed and Sealed this

Fourteenth Day of April, 2009

JOHN DOLL
*Acting Director of the United States Patent and Trademark Office*